US011523476B2

(12) United States Patent
Jean

(10) Patent No.: US 11,523,476 B2
(45) Date of Patent: Dec. 6, 2022

(54) SINGLE-MODE MICROWAVE APPLICATOR, DEVICE AND METHOD FOR THERMAL TREATMENT OF PRODUCTS

(71) Applicant: INOVFRUIT, Saint-Medard-de-Mussidan (FR)

(72) Inventor: Guy Hervé Jean, Mauzens et Miremont (FR)

(73) Assignee: INOVFRUIT

( * ) Notice: Subject to any disclaimer, the term of this patent is extended or adjusted under 35 U.S.C. 154(b) by 344 days.

(21) Appl. No.: 16/068,326

(22) PCT Filed: Jan. 5, 2017

(86) PCT No.: PCT/FR2017/050031
§ 371 (c)(1),
(2) Date: Jul. 5, 2018

(87) PCT Pub. No.: WO2017/118821
PCT Pub. Date: Jul. 13, 2017

(65) Prior Publication Data

US 2019/0029084 A1 Jan. 24, 2019

(30) Foreign Application Priority Data

Jan. 6, 2016 (FR) ..... 1650084

(51) Int. Cl.
*H05B 6/78* (2006.01)
*H05B 6/70* (2006.01)

(52) U.S. Cl.
CPC ..... *H05B 6/782* (2013.01); *H05B 6/701* (2013.01); *H05B 6/707* (2013.01); *H05B 6/784* (2013.01)

(58) Field of Classification Search
CPC ... A23L 3/01; A23L 5/34; A23L 3/001; A23L 5/36; A23L 3/16; A23L 3/358;
(Continued)

(56) References Cited

U.S. PATENT DOCUMENTS 3,535,795 A * 10/1970 Olsen ..... F26B 3/347 34/265
4,406,937 A * 9/1983 Soulier ..... H05B 6/78 219/699

(Continued)

FOREIGN PATENT DOCUMENTS

EP 0036362 A1 * 9/1981 ..... H05B 6/78
EP 0141657 A2 * 5/1985 ..... H05B 6/782
JP 5081925 B2 * 11/2012 ..... A23L 3/54

*Primary Examiner* — John J Norton
(74) *Attorney, Agent, or Firm* — Perman & Green, LLP

(57) ABSTRACT

An applicator for thermal treatment of a product in which the product is exposed to electromagnetic microwave radiation in an exposure waveguide, in which the microwaves are coupled and propagate according to a single-mode propagation mode. The applicator includes a system for transporting the product in a continuous flow following the longitudinal direction of the cavity of the exposure waveguide between the inlet opening and the outlet opening. A product treatment device includes at least one applicator and at least one continuous wave generator CW. The product, heated by continuous microwave radiation CW in device, is subjected to a thermal treatment method in line with a temperature curve as a function of time, resulting in particular from a speed of movement of the product in the exposure waveguide and from a power of the microwave radiation coupled into the exposure waveguide at each coupling point.

9 Claims, 3 Drawing Sheets

(58) Field of Classification Search
CPC ..... A23L 5/20; A23V 2300/10; A23B 7/01; A23B 4/01; A23B 5/01; A23B 7/02; H05B 6/707; H05B 6/701; H05B 6/72; H05B 6/6402; H05B 6/78; H05B 6/782; H05B 6/70; H05B 6/708; H05B 6/802; H05B 2206/045; H05B 6/6411; H05B 2206/046; H05B 6/6408; H05B 6/76; H05B 6/60; H05B 6/763; H05B 2206/04; H05B 6/52; H05B 6/766; H05B 6/784
USPC ..... 34/216, 255, 242, 245, 425, 491, 494, 34/499, 573, 601, 602, 79; 219/690, 756, 219/678, 679, 695, 680, 691, 697, 746, 219/688, 700, 749, 754, 121.43, 682, 684, 219/738, 740, 747, 751, 753
See application file for complete search history.

(56) References Cited

U.S. PATENT DOCUMENTS

| | | | | |
|---|---|---|---|---|
| 4,565,670 | A * | 1/1986 | Miyazaki | F26B 17/20 422/903 |
| 6,294,773 | B1 * | 9/2001 | Chung | H05B 6/782 219/731 |
| 10,139,161 | B2 * | 11/2018 | Fu | A61P 31/04 |
| 2010/0218395 | A1 * | 9/2010 | Durance | A23B 7/02 34/265 |
| 2013/0172526 | A1 * | 7/2013 | Carvajal | B27K 3/0278 530/202 |

* cited by examiner

SINGLE-MODE MICROWAVE APPLICATOR, DEVICE AND METHOD FOR THERMAL TREATMENT OF PRODUCTS

CROSS REFERENCE TO RELATED APPLICATIONS

This application is the National Stage of International Application No. PCT/FR2017/050031, having an International Filing Date of 5 Jan. 2017, which designated the United States of America, and which International Application was published under PCT Article 21(2) as WO Publication No. 2017/118821 A1, and which claims priority from, and the benefit of, French Application No. 1650084, filed on 6 Jan. 2016, the disclosures of which are incorporated herein by reference in their entireties.

BACKGROUND

1. Field

This disclosed embodiment applies to the field of preparing, transforming and preserving all types of products that must be subjected to heat treatment.

More particularly, the disclosed embodiment applies to the field of the heat treatment, through radiofrequency microwaves, of products of any origin containing one or more polarised dielectric materials, i.e. materials generally considered to be electric insulators, and the molecule whereof comprises asymmetrical electrical loads, for example the water molecule $H_2O$.

2. Brief Description of Related Developments

Known methods exist involving the implementation of microwaves of about one or several GHz for preparing food stuffs in particular for the heating or cooking thereof prior to consumption.

Seeds are also known to undergo electromagnetic microwave radiation as part of the industrial preparation of seeds for the improved use thereof in food stuffs.

The European patent application published under number EP 1955603 discloses the shelling of seeds of nuts, for example walnuts, by subjecting the seeds to heating via infrared then via microwaves before mechanically removing the shell.

One difficulty encountered by the method implemented involves accurately controlling the irradiance of the seeds by the microwaves in order to obtain the desired thermal effects, while guaranteeing homogeneous treatment of the seeds in an industrial flow, and without damaging the organoleptic properties of the seeds.

The U.S. Pat. No. 6,270,773 discloses an improved method for stabilising vegetable plants using the enzymes contained in the plant by implementing a rehydration step followed by a radiation pre-heating step then by a microwave heating step, heating to a sufficient temperature to denature the enzymes responsible for degrading the seeds.

The heating of powder or seed food stuffs is also known from the European patent application No. 0036362 to take place by exposure to microwave radiation. The food stuffs are driven in a horizontal direction by an Archimedes' screw so as to be agitated during their passage in the screw, whereby the microwaves are incoupled into the space between a rotary drum comprising a helical partition and a fixed sleeve also comprising a helical partition. In such a device, the partial filling of the cavity by the food stuffs and the continuous deformation of the cavity, during the rotation of the drum, into which the microwaves are incoupled, does not allow for the homogeneous heating of the food stuffs or an optimum heating efficiency.

These devices do not allow the products to be quickly heated in a continuous flow, while guaranteeing a homogeneous temperature in the treated product and a good heating efficiency, and do not allow for the generation of a precise temperature curve or a thermal cycle to which the product should ideally be subjected.

SUMMARY

In order to overcome these problems, this disclosed embodiment relates to an applicator for thermal treatment wherein the particulate product to be treated is exposed to electromagnetic microwave radiation in a cavity, into which electromagnetic waves are incoupled.

In the applicator according to the disclosed embodiment, the cavity is a waveguide cavity, the section whereof is suitable for single-mode propagation, for an implemented microwave frequency, of an exposure waveguide, in which cavity the microwaves propagate in a longitudinal direction of the cavity.

The cavity comprises a product inlet opening and a product outlet opening, separated from the inlet opening in a longitudinal direction of the cavity, and the applicator comprises a system for conveying the product in the waveguide in a continuous flow following the longitudinal direction of the cavity of the exposure waveguide between the inlet opening and the outlet opening.

The conveying system comprises partitions, formed of a material that is transparent to the radiofrequency waves implemented in the applicator, which define the adjoining sliding volumes moving inside the cavity of the exposure waveguide, in the longitudinal direction of said exposure waveguide from the inlet opening towards the outlet opening, so as to maintain total and homogeneous filling of the exposure waveguide by the product during the conveying thereof.

The product, via the passage of a product flow in the cavity of the exposure waveguide, is therefore continuously exposed to an electromagnetic field, which product, as a result of the single-mode propagation in the exposure waveguide and of the guaranteed total and homogeneous filling of the cavity of the exposure waveguide with the product, is treated in a homogeneous manner, avoiding areas in the product from being overexposed to the microwave radiation and areas from being underexposed thereto.

Such a result is obtained through the homogeneity of the flow and of the filling of the product in the volume of the cavity of the exposure waveguide, as well as through the constancy of the exposure time to the microwaves in the exposure waveguide.

The formation of accumulated product and clogging is also prevented from occurring inside the cavity of the exposure waveguide, in particular resulting from uncontrolled behaviour of the particulate product in the absence of the conveying device implemented.

In one aspect of the disclosed embodiment, at least one incoupling waveguide, one far end whereof is connected to the exposure waveguide, at a radio slot of the exposure waveguide, incouples microwaves, propagating in said at least one incoupling waveguide, inside the cavity of the exposure waveguide.

A desired microwave energy is thus incoupled at a determined point of the exposure waveguide.

In one aspect of the disclosed embodiment, the applicator comprises a plurality of incoupling waveguides and each waveguide is connected by a far end to the exposure waveguide at a radio slot of the exposure waveguide. Radio slots allocated to each of the exposure waveguides are distributed between the inlet opening and the outlet opening, offset from one another on the exposure waveguide in the longitudinal direction of said exposure waveguide.

A microwave power can thus be incoupled at each of the radio slots and a given radiofrequency energy profile can be generated in the exposure waveguide, resulting, for the product moving inside the cavity of the exposure waveguide, in a profile of exposure to the microwave radiation and to the effects thereof as a function of time.

Thus, a microwave radiation power in the form of microwave radiation incoupled into the cavity of the exposure waveguide by each of the incoupling waveguides, is defined in order to determine a temperature curve as a function of the time the product circulates in the exposure waveguide.

In one aspect of the disclosed embodiment, the exposure waveguide is a waveguide, for which the line from the centres of the sections of the waveguide is circular, thus forming a toroidal cavity, and the conveying system comprises a rotor, via which the partitioning walls are driven, of which a rotation relative to a fixed structure of the exposure waveguide, constituting a stator, conveys and/or controls the conveying of the product in the cavity.

Such an aspect appears advantageous in terms of the mechanical simplicity of the drive system and in terms of the compactness thereof.

In another aspect of the disclosed embodiment, the exposure waveguide is a waveguide that is open at the ends thereof, for example a linear waveguide with a cylindrical or substantially cylindrical cavity, or a waveguide with a helical cavity, and the conveying system drives the through feed of the sliding volumes in the cavity of the exposure waveguide between the open ends, from one end corresponding to the inlet opening to the other end corresponding to the outlet opening.

The product is thus conveyed in the cavity of the waveguide, which is open at the ends thereof, with a product volume density that is substantially constant throughout the cavity of the exposure waveguide between the ends thereof.

Other open exposure waveguide shapes are, however, possible, for example a waveguide defining an arc of a circle or a more complex shape.

The drive system consists, for example, of a conveyor belt to which the partitions are secured.

Such shapes benefit from an exposure waveguide that is simple to produce since the conveying system is not associated with a mobile wall and in theory poses few problems concerning the imperviousness thereof to microwaves, leaks whereof should be limited as much as possible.

In order to implement components that are industrially-available, the exposure waveguide is a waveguide having a section suitable for single-mode propagation, of standardised dimensions for a frequency of 915 MHz, or a single-mode waveguide of standardised dimensions for a frequency of 2.45 GHz, for example, a waveguide having sections perpendicular to the longitudinal direction, that are rectangular and standardised, for which industrial components (connectors, adapters, sensors, etc.) are available.

In one aspect of the disclosed embodiment, suitable for a temperature profile for performing, in series, steps of rising the temperature of the product, baking or steam cracking, then water extraction, the applicator comprises at least two incoupling waveguides, and a total microwave energy CW incoupled into the cavity of the exposure waveguide is distributed between the incoupling waveguides.

For example, with three incoupling waveguides, from the inlet opening to the outlet opening, substantially half of the total microwave energy CW is distributed in a first incoupling waveguide, substantially one quarter thereof in a second incoupling waveguide and substantially one quarter thereof in a third incoupling waveguide.

In one aspect of the disclosed embodiment, in order to increase the product treatment capacities of an applicator, the applicator comprises a plurality of exposure waveguides, the structures whereof are similar and arranged to operate in parallel.

A compact applicator is thus obtained, having an increased treatment capacity and sharing accessory components, for example drive motors, product dispensers and collectors.

The disclosed embodiment further relates to a device for the thermal treatment of a product containing at least one polarised dielectric material, wherein the product is exposed to electromagnetic microwave radiation from a wave generator in a cavity, into which electromagnetic waves are incoupled, which comprises at least one applicator according to the applicator disclosed hereinabove and which comprises at least one continuous wave CW generator arranged so as to generate microwaves with an energy level determined according to the product and temperatures to which the product must be brought and at a frequency corresponding to single-mode propagation of microwaves in incoupling waveguides and in the one or more exposure waveguides.

An installation is thus obtained for the thermal treatment of products sensitive to microwaves with the advantages of the applicator according to the disclosed embodiment.

In one aspect of the device, the wave generator comprises at least one high-frequency head, the generated microwave energy whereof is divided, by at least one divider, in order to be carried, by at least two incoupling waveguides, to an exposure waveguide.

In one aspect of the disclosed embodiment, each incoupling waveguide comprises an impedance matching adapter for changing the impedance of the incoupling waveguide considered, whereby all of the incoupling waveguides, the impedance matching adapters and the dividers form a wave distributor, in which the microwave power distributed in each of the incoupling waveguides is managed via a network by adjusting the impedance matching adapters. The power distribution between the incoupling waveguides can thus be modified without being limited to the capabilities specific to the dividers.

For example, the microwave energy generated by a high-frequency head is divided twice in order to be conveyed by three incoupling waveguides to the exposure waveguide. Advantageously, each divider can be adjusted so as to adjust the power distribution in each of the outlets of the divider.

The number of sources generating the microwaves used by the device is thus limited.

In order to produce an industrial installation, a wave generator associated with an exposure waveguide advantageously generates a maximum total power output, during operation, in the form of microwaves centred at a frequency of 915 MHz, that is substantially equal to 75 kW, which power output is compatible with the maximum power outputs currently reached by microwave generators in this frequency range.

In order to optimally use the microwave energy generated and to prevent reflection of the waves back towards the source, at least one and preferably each incoupling waveguide comprises an impedance matching adapter in order to adapt the output impedance thereof to the impedance of the load thereof in the exposure waveguide.

The device allows for the implementation of a method for treating a plant-derived product by exposure to microwave radiation in an applicator according to the applicator of the disclosed embodiment, in which method the product is continuously conveyed inside a cavity of the exposure waveguide, along a length of said cavity from the inlet opening of the cavity to the outlet opening of the cavity, in which exposure waveguide the microwave radiation propagates under single-mode propagation conditions. The method thus allows a continuous flow of the product to be treated, which is subjected to very homogeneous microwave levels, which result in the full treatment of the product that is conveyed in the exposure waveguide.

The microwave radiation is, for example, incoupled into the exposure waveguide at at least two different incoupling points along the length of the cavity. Conditions are thus obtained that can be modified during the conveying of the product in the exposure waveguide so as to successively subject the product to the thermal conditions resulting from the exposure to the electromagnetic fields determined for the product considered and the desired treatment.

In one implementing method, distribution of the microwave power, produced by a high-frequency head and divided to feed the incoupling waveguides, inside each of the incoupling waveguides is managed via a network by adjusting impedance matching adaptors of the incoupling waveguides.

In one aspect of the disclosed embodiment, the conveying speed of the product in the exposure waveguide and a continuous microwave CW radiation power incoupled into the exposure waveguide at each incoupling point are determined in order to heat the product according to a desired temperature curve as a function of time.

The method is implemented depending on the case:

for mostly plant-derived products;

for mostly animal-derived products;

for mostly mineral-derived products.

In one aspect of the disclosed embodiment, the product is a mixture of products from two or three plant, animal or mineral sources.

Treatment using the method comprises at least the following steps, depending on the case:

- a heating step; and/or
- a step of steam cracking the molecular chains of the product; and/or
- a baking step; and/or
- a dehydration step; and/or
- a grilling step; and/or
- a roasting step.

BRIEF DESCRIPTION OF THE DRAWINGS

The detailed description of example aspects of the disclosed embodiment is provided with reference to the figures which diagrammatically illustrate, in a non-limiting manner.

DETAILED DESCRIPTION

In the figures, similar components are referenced with the same references.

In the different views, the illustrative side of a device and of an applicator implemented by the device have been prioritised, and the scales between the different components shown are not necessarily identical.

Figure 5:
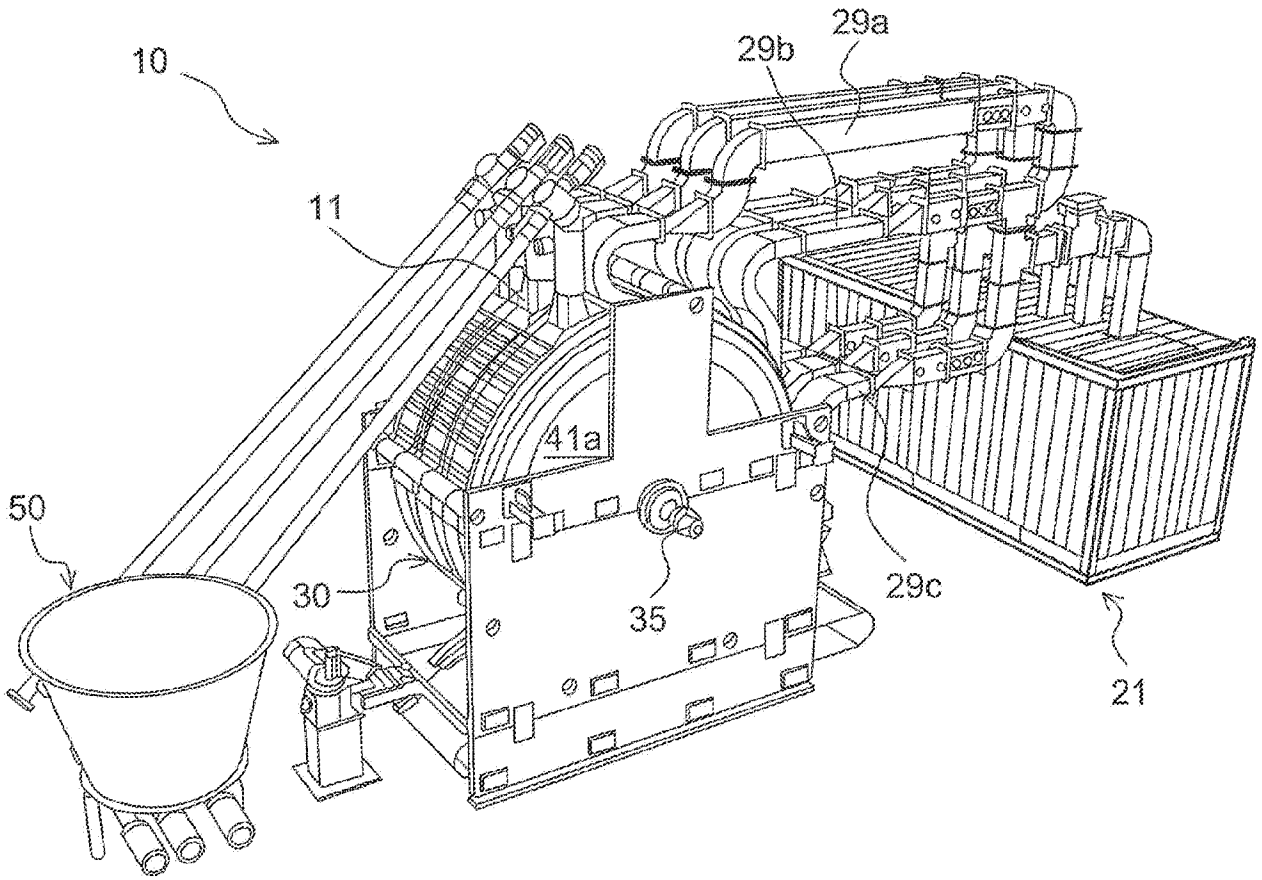
FIG. 5: one example of a device comprising an applicator, wherein a plurality of exposure waveguides with toroidal cavities are combined.

However, FIG. 5 shows, by way of an example aspect, a drawing of a device according to the disclosed embodiment having a shape and proportions similar to a device produced using technological components currently available and suitable for industrial implementation.

Figure 1:
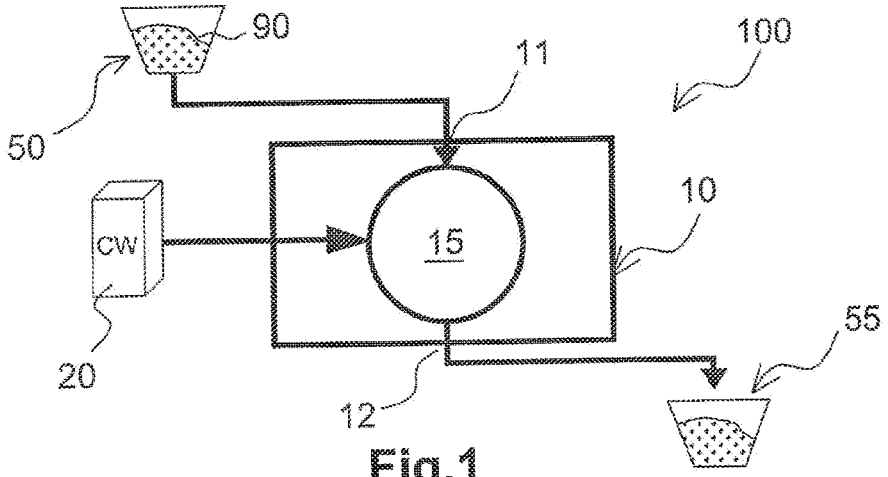
FIG. 1: a device according to the disclosed embodiment for the thermal treatment of food stuffs with the main sub-assemblies of the device.

FIG. 1 diagrammatically illustrates a device 100 according to the disclosed embodiment intended for treating products using temperature.

The products can be plant-, animal- or mineral-derived products, provided that they contain one or more polarised dielectric materials absorbing radiofrequency waves, in particular the radiofrequency waves in the microwave range, i.e. the frequencies whereof lie in the range 800 MHz to 3 GHz according to current understanding.

In a generic manner, the term "product" 90 will be understood herein to describe the products that must be treated by exposure to microwave radiation by means of the device. The same term and reference numeral will be used to identify the product in the different treatment steps to which it is subjected during the passage thereof in the device 100, independently from the physical-chemical transformations that it may undergo therein.

Microwave Generator

The device 100 comprises an electromagnetic wave generator 20 generating continuous waves, referred to as CW, in the microwave range, i.e. waves having frequencies lying in the range 800 MHz to 3 GHz.

The frequency values implemented are not mandatory and can be chosen as a function of the technical restrictions of each case at hand.

Advantageously, the generator is suitable for generating microwaves centred at a determined frequency, the choice whereof directly depends on that of the cross dimensions of the waveguides suitable for propagating said waves, which waveguides in the device according to the disclosed embodiment are also implemented to convey products 90 to be treated.

The electromagnetic wave generator 20 of the device generates waves centred at a determined frequency, for example the frequency of 915 MHz, which corresponds to a frequency administratively allocated to public applications. The expression "the microwave frequency" must be understood herein as being the frequency at which is centred an emission spectrum of the wave generator.

The generator is a continuous wave generator capable of continuously generating, at least over a period of time suited to the time scale of the implementation thereof in the device, a rated power of said wave generator. Within the scope of the disclosed embodiment and the implementation of the wave generator, the generator is not prohibited from modulating the wave emission duration to adjust an average power output in an operating cycle of the generator. Such a mode with modulation of the microwave emission duration is, when produced with a smaller period relative to a speed at which the products exposed to said microwaves are conveyed within the scope of the disclosed embodiment, considered to be a continuous mode CW of operation of the generator in order to obtain a continuous average power output that is less than the continuous maximum power output.

Applicator

The device 100 comprises at least one continuous heating applicator 10 in which the products are conveyed between an inlet 11 of the applicator and an outlet 12 of the applicator.

According to one characteristic of the applicator 10, the products are conveyed in an exposure waveguide 30 of the applicator, in a longitudinal direction of a cavity 32 of said exposure waveguide.

The longitudinal direction corresponds to a direction of propagation of the waves in the waveguide.

During the conveying thereof in the exposure waveguide 30, the products are exposed to the microwaves generated by the wave generator 20 propagating longitudinally inside said exposure waveguide according to a single-mode propagation mode.

The single-mode propagation of radiofrequency waves in a waveguide is known and widely implemented in applications requiring the transfer of radiofrequency power with minimal loss, for example in radar devices for transmitting energy between a generator and an antenna. Single-mode propagation is obtained by a section, perpendicular to the longitudinal direction, of the cavity of the waveguide in which the radiofrequency wave propagates, suited to the frequency of said radiofrequency wave.

Figure 2:
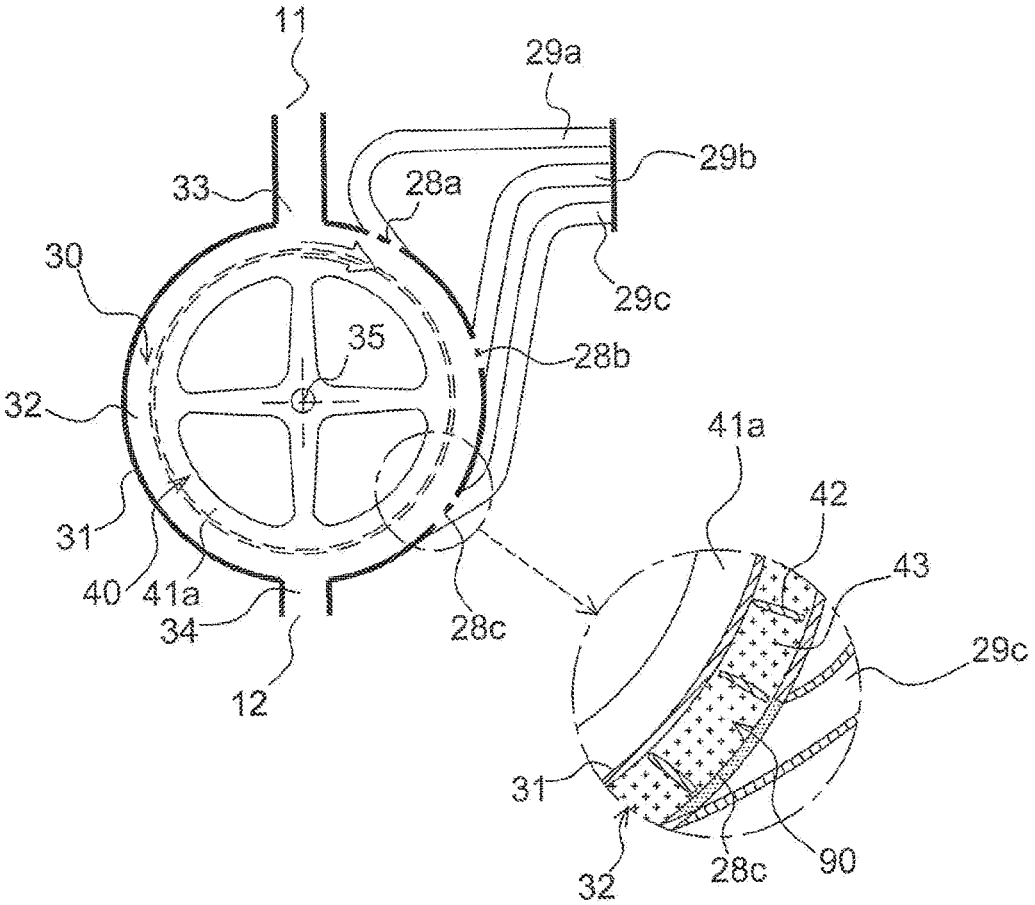
FIG. 2: a first aspect of the disclosed embodiment of an applicator having a single-mode exposure waveguide with a toroidal cavity.

FIG. 2 shows one example of a furnace 15 of the applicator 10 and comprising an exposure waveguide 30.

In the aspect shown in FIG. 2, the exposure waveguide 30 defines a toroidal cavity, the section whereof is chosen to ensure the single-mode propagation of the waves implemented.

The toroidal shape of the cavity is not limited to the sole case of a circular section of the waveguide in an axial plane of the torus, whereby a circular section is generally understood according to a purely mathematical definition of the torus. As shown in the description below and in the drawings, the torus defines a tubular cavity having a substantially constant, rectangular section in the examples shown, for which a line from the centres of the sections defines a circle.

The exposure waveguide 30 is also arranged to allow for the conveying, in the cavity of said exposure waveguide, at a controlled speed, of products to be exposed to the microwaves.

In the example using the selected frequency of 915 MHz, the exposure waveguide has a cavity with a substantially rectangular section of 248 mm in width and 124 Mm in height, which dimensions ensure the single-mode propagation of the microwaves centred at said frequency.

In a known manner, the exposure waveguide 30 has the overall shape of a tube 31, the walls whereof are electrically conducting, for example made of a good electrically-conducting material such as copper, aluminium or silver, etc. or at least comprising a layer of an electrically-conducting material deposited on inner walls of said tube, and one centre portion whereof defines a volume transparent to the radiofrequency waves. In practice, in the case of the disclosed embodiment, the centre portion of the waveguide tube is a cavity 32 containing, aside from the product that is to be exposed to the microwaves, air which appears suitable to most exposure cases considered.

The diagram in FIG. 2 corresponds to an exposure waveguide 30 having a toroidal shape with a cavity 32 having a rectangular section in an axial plane of the torus.

The exposure waveguide 30 has, in one wall of said exposure waveguide, an inlet opening 33 through which products 90 to be exposed to microwave radiation are fed into the cavity 32 of said waveguide, and an outlet opening 34 through which the products 90 having been exposed to microwave radiation leave said waveguide. A length Lgo of the exposure waveguide 30 between the inlet opening 33 and the outlet opening 34 along which the products are conveyed defines a distance over which said products can be exposed to the microwaves.

The exposure waveguide 30, in the example shown in FIG. 2, is fixed, at least partially, placed with a horizontal axis of revolution 35 of the torus, with the inlet opening 33 located at a high point of the torus and the outlet opening 34 located at a low point of the torus, and in the example illustrated substantially at a point that is diametrically opposite the inlet opening.

The exposure waveguide 30, at least one fixed wall of the tube 31 of said waveguide, constitutes, from a mechanical perspective, a stator of a conveying system 40 for conveying the products 90.

Moreover, a rotor 41*a* comprising a set of partitions 42, substantially arranged in radial planes spaced angularly apart from one another so as to be preferably, substantially equally-spaced, defines, in the toroidal cavity 32, adjoining sliding volumes 43 driven at a speed corresponding to a rotational speed of the rotor 41*a*. Thus, two immediately-adjoining sliding volumes are only separated by a partition in the waveguide so that, when the sliding volumes are full of product, the exposure waveguide is also full of said product, to the same extent minus the thickness of the partitions.

The sliding volumes ensure the continuous conveying of the products 90 subjected to the microwave radiation in the toroidal cavity 32 at a controlled flow speed of said products, which become confined in a sliding volume by the walls of the tube 31 and the two partitions defining said sliding volume. The partitions 42 also ensure the homogeneous filling of the exposure waveguide with the product. More specifically, on the one hand, the product is retained in the sliding volume into which it was fed, without being able to move randomly inside the cavity of the waveguide until leaving through the outlet opening 34, and on the other hand, the total filling of the sliding volume with the product prevents the formation of heterogeneity within said sliding volume, which would be the case for partial filling, when the product is conveyed.

The partitions 42 are separated from one another by a separation distance between neighbouring partitions, along the perimeter of said toroidal cavity, in order to define a product loading capacity of a sliding volume 43.

The choice of separation distance between the partitions 42, which can depend, in the specific cases, on the product 90 and on a device for loading sliding volumes with product, is determined so that a volume contained between two neighbouring partitions is always full of the product 90 when said volume is in a part of the exposure waveguide 30 into which the microwaves are incoupled. It is understood that the volume is considered to be full of the product when the loading device implemented can no longer be used to feed more product into the volume in question, even in the presence of interstitial voids between the seeds of the material. This condition for filling, which is as homogeneous as possible in practice, of the sliding volumes 43 in the cavity of the exposure waveguide in which the products are exposed to the microwaves, is key in obtaining a homogeneous volume density of the product in the exposure waveguide, which results in an electromagnetic field that is also homogeneous within the products treated.

In the absence of sufficiently homogeneous filling of the cavity of the exposure waveguide, the distribution of the microwave energy in the exposure waveguide would not be homogeneous and excessive temperature variations would be formed in the product, achieved as a function of the position thereof inside said cavity, which must be avoided.

In one example aspect, the partitions are angularly separated from one another by 30° so as to form six successive sliding volumes rotating in the cavity of the exposure waveguide, in the case shown wherein exposure to the microwaves occurs over an angular sector of 180°. However, this 30° value is not limiting and can be adapted as necessary, to a higher or lower value, to suit the product treated and the behavioural characteristics thereof so as to ensure the total filling of the volumes and the necessary product flow to ensure that the volumes are filled and emptied.

The partitions 42 are made of a material that is transparent to the electromagnetic waves at the frequencies considered, at least of a low-attenuation material, such that the microwaves propagate inside the cavity 32 of the exposure waveguide with minimal attenuation linked to the partitioning of the sliding volumes 43.

Conversely, portions of the rotor, in particular walls of the waveguide directly or indirectly used to support the partitions, are formed from conductive materials and arranged, relative to the other portions of the waveguide, so as to prevent microwave leaks and energy losses by radiation.

In the context of industrial production of the device, in order to take into account the regulations and to benefit from existing technology and technical components, the implementation of standardised frequencies for the type of application considered is preferable.

Thus, a microwave frequency of 915 MHz corresponds to a standardised waveguide with a cavity section of 247.65 mm×123.82 mm.

In such a waveguide of standardised dimensions (standard EIA WR975 or standard IEC R9) in the radiofrequency range, microwave radiation occurs via single-mode propagation.

Other microwave frequencies can also be implemented, provided that waveguides are used having dimensions that are suitable for a single-mode propagation mode. For example, for a frequency of 2450 MHz, a standardised, adapted waveguide (WR340 or R26) has a cavity section of 86.36 mm×43.18 mm.

According to a general physical principle, the higher the frequency used, the smaller the section of the waveguide, and this restriction concerning the section for obtaining a single-mode waveguide will be taken into account.

A device of the disclosed embodiment intended for the industrial use of treating a product at a high volume flow rate will have the advantage of implementing the lowest possible microwave frequencies compatible with the desired thermal effects in order to benefit from waveguides having the largest possible sections.

Microwave Distributor

The device 100 further comprises a microwave distributor for supplying energy to the applicator 10. FIG. 2 shows three incoupling waveguides 29*a*, 29*b*, 29*c* that convey the microwaves from the wave generator 20 to the exposure waveguide 30. Each of the incoupling waveguides is coupled in a substantially tangential manner to the exposure waveguide 30 by a radio slot, respectively 28*a*, 28*b*, 28*c*, so as to ensure, in the example shown, propagation of the microwaves in the toroidal cavity 32 in a direction in which the products 90 are conveyed inside said toroidal cavity of the exposure waveguide, i.e. in the direction of rotation of the rotor 41*a*.

Moreover, each of the incoupling waveguides 29*a*, 29*b*, 29*c* are coupled to the exposure waveguide 30 at different points between the inlet opening 33 and the outlet opening 34 so as to define, inside the cavity 32 of said exposure waveguide, successive areas of exposure over the length Lgo, each exposure area corresponding to a volume of the exposure waveguide 30 mostly subjected to the energy of the waves incoupled by one of the incoupling waveguides and absorbed by the product.

The tangential incoupling of the waves into the waveguide at each slot further prevents reflections capable of re-incoupling energy towards the wave generator 20.

In the waveguide having a toroidal cavity corresponding to the aspect of the disclosed embodiment shown in FIG. 2, each of the exposure areas corresponds to an angular sector of a portion of the toroidal cavity 32 in which the products 90 are conveyed between the high point and the low point of said exposure waveguide.

When the device is in operation, the electromagnetic wave generator 20 generates microwaves in each of the incoupling waveguides 29*a*, 29*b*, 29*c* with a desired power that is to be incoupled into the exposure area corresponding to the incoupling waveguide considered.

The electromagnetic wave generator 20 can comprise a plurality of high-frequency heads generating microwaves, whereby a head is allocated to a single incoupling waveguide or to a limited number of incoupling waveguides.

Advantageously in this aspect, each high-frequency head is arranged such that it allows the power transmitted in the corresponding incoupling waveguide to be adjusted.

Figure 3:
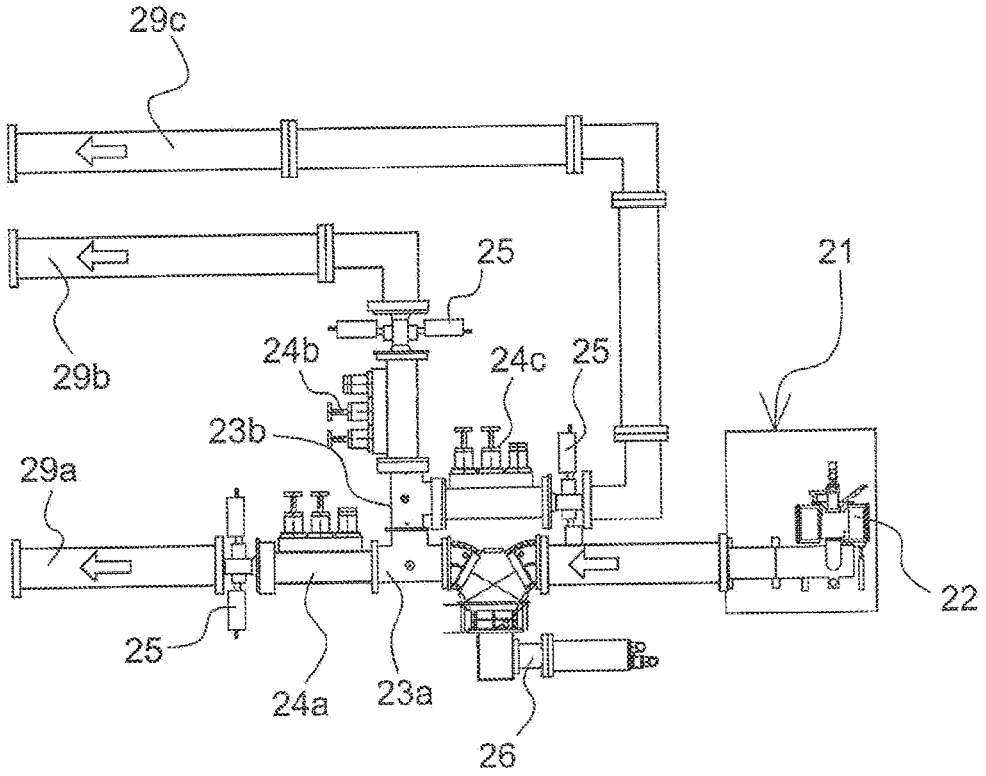
FIG. 3: one example of a CW wave generator implementing a single high-frequency head, the power output whereof is distributed over three incoupling waveguides.

In one aspect of the wave generator 20, an example whereof is shown in FIG. 3, the electromagnetic waves being at the same frequencies for all incoupling waveguides 29*a*, 29*b*, 29*c*, said electromagnetic wave generator comprises a single high-frequency head 21, the energy whereof is divided and adjusted as a function of the power outputs to be supplied in each incoupling waveguide.

For example, a first divider 23*a* distributes the total power output of the high-frequency head 21 in half over each of the two outlets of said first divider. A first outlet of the first divider 23*a* is connected to a first incoupling waveguide 29*a*, which must be supplied with 50% of the microwave energy generated by the high-frequency head 21. The remaining power at a second outlet of the first divider 23*a* is divided in half again between two outlets of a second divider 23*b*, each of which are connected to a second and a third incoupling waveguide 23*a*, 23*b*, each of which must be supplied with 25% of the microwave energy generated by the high-frequency head 21.

In accordance with good engineering practices in the field of power transfer, the necessary impedance matching will take place, for each of the incoupling waveguides, in order to ensure optimal transfer of the power and prevent the re-injection of power to a source 22 of the high-frequency head.

Advantageously, each waveguide 23*a*, 23*b*, 23*c* comprises an impedance matching adapter, respectively 24*a*, 24*b*, 24*c*, for adjusting the output impedances to the load impedances corresponding to the product exposed in the exposure waveguide, whereby the adaptation takes place according to information transmitted by the sensors 25 for measuring the energy emitted and the energy reflected in each waveguide. Advantageously, in order to protect the source 22, a recirculator 26 is arranged at the outlet of the high-frequency head 21 in order to trap waves that would otherwise be re-injected into the generator.

In one aspect of the disclosed embodiment, each impedance matching adapter 24*a*, 24*b*, 24*c* of an incoupling waveguide is implemented in order to control the power supplied to said incoupling waveguide such that the resulting wave distributor forms a networked energy management system, allowing adjustment of the distribution of the power, supplied by the high-frequency head 21, between the different incoupling waveguides.

In this aspect, an impedance matching adapter 24*a*, 24*b*, 24*c*, as a function of the adjustment thereof, re-injects power over the network, which power was initially distributed by the dividers 23*a*, 23*b*, but not used, i.e. which power was not absorbed by the product. This re-injected power can thus be used by the other incoupling waveguides.

In this aspect, the energy can be distributed in a precise manner in order to adapt the thermal profile in the exposure waveguide, without being dependent on the sole division factors specific to the dividers 23*a*, 23*b*.

In practice, the distribution of the power between the different incoupling waveguides, as for the effective power of the electromagnetic radiation in each incoupling waveguide, will be adapted by a person skilled in the art according to the type of products treated by the device, the absorption capacities and thermal behaviour whereof differ from one product to the next, according to the product flows treated in the exposure waveguide, for example a mass flow in g/s, and also according to the temperatures to which the products must be brought in each of the exposure areas as a function of the desired effects on the products.

In one aspect of the disclosed embodiment, the power outputs in each incoupling waveguide are adjusted during the implementation of the applicator as a function of measured parameters such as the product temperature at different points of the exposure waveguide.

A person skilled in the art is thus able to create, in the product, during the conveying thereof in the exposure waveguide, a temperature profile as a function of time.

Implementation of the Device

Advantages and benefits of the device disclosed above shall in particular be better understood upon reading the description of one example implementation of the device.

In the device, the product is presumed to be in a fragmented form, which gives the product natural flow capacities. Examples of fragmented products are provided at a later stage in the description and the product will be considered in a generic manner as a granular product.

In the device, a product 90 that is granular, either naturally or after preparation, to be treated by heating is, in a first step, placed in a feeding distributor 50, for example a tank comprising a hopper for driving the product in a duct, substantially having the same section as the exposure waveguide, towards an inlet 11 of the applicator 10.

The product is driven, for example, by gravity, by a hopper, by an auger or by any other known system suitable for conveying the product considered, in particular relative to the grain size thereof, the fluidity thereof and the texture thereof, in particular to prevent the blocking or clogging during conveying from the tank to the exposure waveguide 30.

The duct advantageously has substantially the same section as the exposure waveguide implemented in the device to ensure that the product is conveyed in a stable manner towards the inlet opening 33 of the exposure waveguide.

The product, once fed into the exposure waveguide 30 through the inlet opening 33, is continuously conveyed at a controlled speed inside said exposure waveguide by the rotor 41*a* as far as the outlet opening 34.

Where applicable and before being fed into the cavity of the exposure waveguide, the product 90 is preheated. Preheating, for example to a value chosen from the range 30° C. to 55° C. and not having any substantial effect on the products to be treated, reduces the microwave power required to rise the temperature of the product in the exposure waveguide and allows the product to be fed into the exposure waveguide at a temperature and thus under initial conditions that remain substantially constant in the waveguide.

In the cavity 31 of the exposure waveguide, the speed at which the product 90 is conveyed is imposed by the rotational speed of the rotor 41*a*, which results in a determined exposure duration of the product to the microwave radiation conditions in each of the areas of the exposure waveguide receiving microwave energy via the incoupling waveguides 29*a*, 29*b*, 29*c*.

With regard to the product, this exposure duration is particularly stable and reproducible since the product is substantially immobile inside the sliding volumes 43.

The rotor 41*a* is advantageously driven in rotation at a constant speed by a motor, for example an electric or hydraulic motor.

However, other rotational drive means are possible. For example, the rotor can rotate freely and be driven in rotation by gravity under the effect of the weight of the product, provided that a downwards trajectory is followed by the product in the waveguide, whereby the rotor speed is, in this case, advantageously controlled by a brake.

In the rotor 41*a*, the product 90 conveyed is contained inside the sliding volumes 43, between the partitions 42, which configuration results in a continuous flow and perfect control of the time of passage in the exposure waveguide, and in each of the areas of the exposure waveguide corresponding to the different supplies of microwave energy from each of the incoupling waveguides, of all volumes of product conveyed between the partitions 42.

Moreover, the conveying of the product by the rotor 41*a* reduces the risk of an exposure waveguide from becoming clogged relative to an unforced flow of the product, for example a gravity-propelled flow, when the product's behaviour is not fluid enough for gravity-propelled flow in the exposure waveguide.

It also prevents temperature differences from arising, which could result from movement, wherein the product is agitated in a more or less random manner, for example in an environment partially loaded with product.

During conveying of the product 90 in the exposure waveguide 30, the wave generator 20 is kept in operation in order to generate the continuous microwaves (CW), which are incoupled into the cavity 32 of said exposure waveguide by the incoupling waveguides 29*a*, 29*b*, 29*c*.

Where applicable, the impedances are adapted for each waveguide so as to compensate for the variations in the dielectric characteristics of the product treated.

In practice, when the product 90 reaches the outlet opening 34, the microwave energy incoupled into the exposure waveguide 30 has been absorbed by the product, whereby the incoupled energy levels are adjusted as necessary according to the product treated and the implementation parameters in order to obtain said outcome, residual energy being, where applicable, retained by a conventional microwave trap.

In this mode of operation, the tangential, or at least oblique incoupling of the microwaves by the incoupling waveguides 29*a*, 29*b*, 29*c* into the exposure waveguide 30 must also be noted to reduce the risks of reflections that could have the negative effect of re-incoupling a part of the waves towards the one or more sources 22 of the microwave generator 20.

In one non-limiting example of an industrial device, the maximum microwave energy continuously generated, at the frequency of use of 915 MHz, by the generator, is 75 kW.

This power can be adjusted, as required, to lower values in order to meet specific conditions and microwave absorption capacities of the product to be heated.

In one aspect, sensors measuring the energy level of the microwave radiation in the cavity 32 of the exposure waveguide transmit energy level measurements, which measurements are used to determine the absorption capacities of the product at all times and, via a control system, to adjust the microwave power levels incoupled by the different incoupling waveguides 29*a*, 29*b*, 29*c* in real time.

In one example implementation, the first incoupling waveguide 29*a*, considered to be first along the path taken by the product in the exposure waveguide 30, receives about 50% of the energy generated by the wave generator 20, i.e. it continuously receives, in the example considered, a maximum power of 37.5 kW, which is incoupled into a first exposure area.

In this first exposure area, the temperature of the product is raised under these conditions without water extraction.

In the example of plant-derived seeds being treated, for example for oil seeds that must be subjected to a specific temperature profile, the temperature of the seeds is brought to 85° C. during this first exposure, which temperature is homogeneous in the product considered with maximum deviations obtained by the method of less than 5 degrees centigrade.

The second incoupling waveguide 29*b*, considered to be second along the path taken by the product in the exposure waveguide, receives about 25% of the energy generated by the generator, i.e. in this example, it continuously receives a maximum power of 18.75 kW, which is incoupled into a second exposure area and which brings the temperature of the product to 115° C.

In this second area, in the case of the example of oil seeds being treated, a step takes place for baking and steam cracking the long molecular chains contained in the treated product for improved subsequent transformation of the components of the product, for example to extract oils or proteins.

Exposure to these temperatures further denatures the lipases contained in the seeds which are responsible for the degradation of the seeds and of the by-products thereof, such as the oils that will be extracted from the seeds in a subsequent step for using the product treated by the method.

One advantage of controlling the temperature and the homogeneity thereof in the product during this phase is that it obtains the desired outcome throughout the volume of the product treated, while preserving the structure of the food components and without modifying the organoleptic properties of the product.

The third incoupling waveguide 29*c*, considered to be third along the path taken by the product in the exposure waveguide, receives about 25% of the energy generated by the generator, i.e. in this example, it continuously receives a maximum power of 18.75 kW, which is incoupled into a third exposure area, in which the temperature reached in the second area is maintained.

In this third area, in the example of oil seeds, water is extracted and adjusted to maintain a desired residual water quantity, for example equal to about 4%, so as to preserve the product's pressing capabilities and obtain, after the treatment, better pressing conditions and a more complete extraction of the oil contained in the product.

As previously stated, the effective power transferred to the product by each incoupling waveguide can be controlled by the impedance matching adapters.

As a whole, this energy distribution inside the cavity 32 of the exposure waveguide 30 produces homogeneous heating of the product and a temperature curve as a function of the time during which the product is subjected to this energy during the conveying thereof in said exposure waveguide.

This temperature curve can be adjusted by modifying the parameters such as the power levels incoupled into the exposure waveguide by each incoupling waveguide, or by implementing a different number of incoupling waveguides to the three in the aforementioned example, for example one, two, four or more incoupling waveguides, or such as the flow speed of the material in the exposure waveguide.

By moderately raising the temperature in the first sector, the water content of the material can be maintained, said water content being capable, for example, of contributing to accelerating the enzyme activity for the remainder of the product treatment process.

The temperature obtained as a result of the interactions of the microwaves with the material of the product, is particularly homogeneous within the device.

Inside the device 100, this results in limited temperature deviations within the material, at different points of the same cross-section of the waveguide. Experiments show deviations of less than 5° C. with the device.

When the granular product 90 reaches a point facing the outlet opening 34, it is removed from the applicator towards an outlet 12 for subsequent steps of treating, conditioning, storing or using the treated product.

In one implementation, the treated product is removed from the exposure waveguide 30 by gravity.

However, other removal modes can be implemented, alone or in any combination thereof, for example by blowing the product or for example by mechanical forcing.

Alternative aspects of the example shown and described in detail of a device according to the disclosed embodiment exist without leaving the scope of the disclosed embodiment.

As stated above, the number of incoupling waveguides can differ from three, and the power in each of the incoupling waveguides can be different from that of the example embodiment disclosed.

In practice, the number of incoupling waveguides and the power supplied by each of said incoupling waveguides are suitable for distributing energy flows incoupled into the exposure waveguide, which energy flows result, for a product, in a temperature profile as a function of the position in the exposure waveguide, i.e. as a function of the time during which the product is to be subjected thereto during the conveying thereof in the exposure waveguide.

It must be understood herein that the temperature to which the product is brought results from the direct absorption of the microwave energy by said product and that said temperature depends not only on the microwave power incoupled into the exposure waveguide, but also on the product's capacity to absorb said microwave energy.

In the case of an exposure waveguide having a toroidal cavity, the angular sector through which the product passes is not necessarily limited, as is the case in the example shown, to an angle of 180°. In practice, given that the product is driven by the rotor 41*a*, this angle can be less than or greater than 180°, without being limited by gravity restrictions.

Similarly, the axis of the exposure waveguide having a toroidal cavity, or the rotational axis of the rotor, is not necessarily horizontal and can have any orientation in space, for example it can be vertical.

The exposure waveguide having a toroidal cavity and a rectangular section in the first aspect described hereinabove, can take on other shapes.

Figure 4:
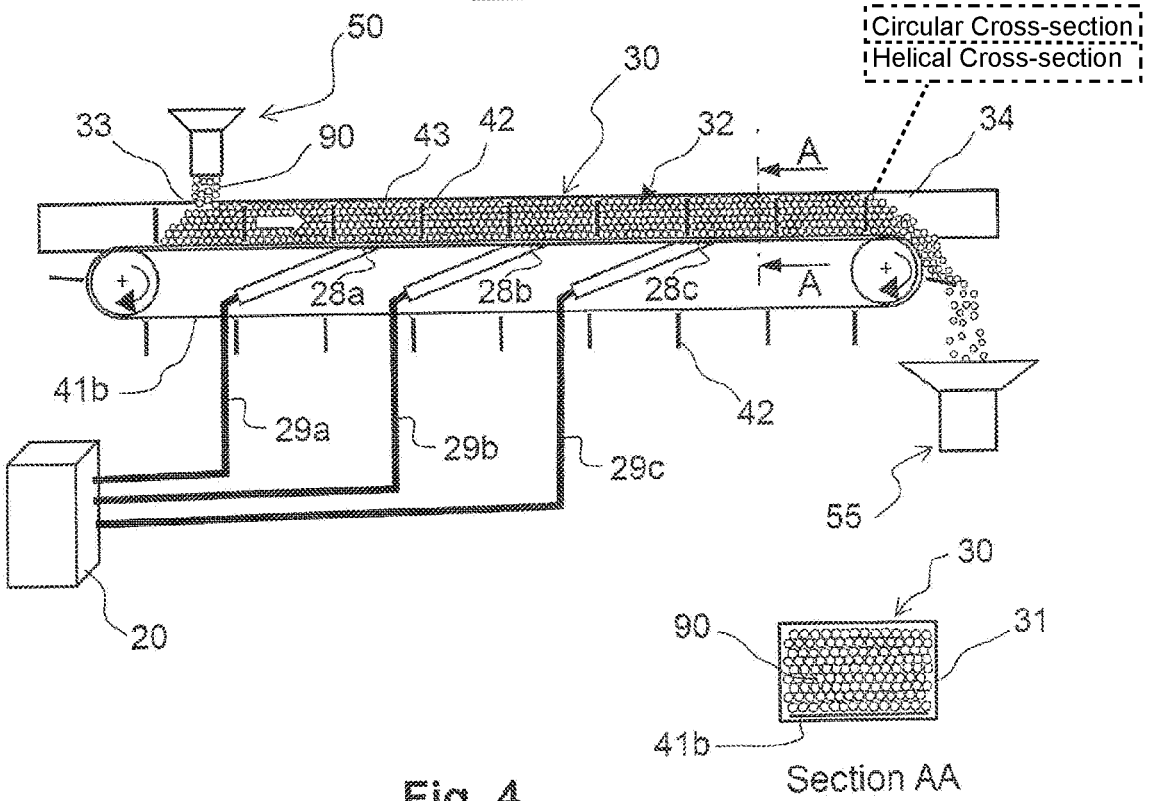
FIG. 4: a device according to the disclosed embodiment implementing a second aspect of the disclosed embodiment of the applicator having a linear waveguide.

For example, FIG. 4 shows a device according to the principles of the disclosed embodiment, wherein the exposure waveguide is linear. In FIG. 4, a side wall of the exposure waveguide is not shown in order to view the product inside said waveguide.

In this disclosed embodiment, the cavity of the waveguide, as shown in detail under "section AA" in FIG. 4, also has a rectangular section and dimensions suitable for the single-mode propagation of the microwaves.

The product 90 passes through the cavity 32 of the exposure waveguide from an inlet opening 33 through which said product is fed, to an outlet opening 34 through which the treated product is discharged.

In this disclosed embodiment, the drive system 40 advantageously consists of a continuous belt 41*b* forming a loop that is functionally identical to the rotor 41*a* and suitable for conveying the product, deposited on said belt, along an axis of the exposure waveguide.

In the example shown in FIG. 4, the exposure waveguide 30 is oriented with a longitudinal axis of said exposure waveguide that is horizontal, and in such a case, the product can be deposited so as to fill sliding volumes 43 defined by partitions 42, which are vertical in the example shown, to ensure the filling of said sliding volumes and a substantially constant volume density of the product in the exposure waveguide.

The partitions guarantee, on the one hand, that the waveguide is kept full in a homogeneous manner, and on the other hand, that the product flows without the risk of sliding relative to the belt. Uncontrolled sliding of the product on the belt, or agitation of the product, would change the product's exposure time to the microwaves or would make the exposure time of an element of the product random, thus changing the product density in the exposure waveguide in an unforeseeable manner, affecting the propagation of the microwaves and capable of leading to the clogging of the waveguide, which phenomena must be avoided in order to obtain the temperature profiles of the product in the exposure waveguide.

Moreover, the implementation of partitions allows the longitudinal axis of the exposure waveguide to be placed in any position, for example in an inclined or vertical position, without this resulting in product flow in the longitudinal direction of said waveguide, which would not allow a constant volume density to be maintained in the exposure waveguide.

In general, a line from the centres of the sections of the exposure waveguide can have any trajectory, for example it can be spiral, for example with a curved portion and a rectilinear portion allowing, where applicable, the number of radio slots through which the microwaves are incoupled into the exposure waveguide to be increased, without necessarily increasing the diameter of a toroidal exposure waveguide or without necessarily reducing a distance between two radio slots, in so far as a conveying system can be implemented to convey the product at a controlled speed over the exposure length of said exposure waveguide while maintaining filling of the waveguide.

Advantageously, the microwaves are incoupled into the exposure waveguide through radio slots 28*a*, 28*b*, 28*c* with an angle of incidence of the incoupling waveguides 29*a*, 29*b*, 29*c* that is preferably less than 30° in order for the waves to propagate in the exposure waveguide with minimal risk of reflection towards the source of the incoupled microwaves.

Advantageously, regardless of the shape of the exposure waveguide, the radio slots are closed by plates made of a dielectric material that is transparent to the microwaves, which prevent the product or dust from entering one of the incoupling waveguides.

It should be noted that, although the rectangular section considered for the exposure waveguide in the aspects disclosed is suitable for the means implemented for the controlled conveying of the product inside the cavity of said exposure waveguide, said shape of the section is not mandatory and different section shapes, for example circular, oval or polygonal shapes, can be used provided that the section chosen results in the single-mode propagation of the waves in the cavity of the exposure waveguide and are suitable for the total filling of the sliding volumes 43.

In improved disclosed embodiments, in order to increase product treatment capacities, a device comprises a plurality of exposure waveguides arranged in parallel.

FIG. 5 shows one example of a device comprising three exposure waveguides according to the first disclosed aspect, having toroidal cavities and conveying the product via rotors.

In this example, the exposure waveguides share, for example, the same rotational drive of the rotors, assembled on the same rotational axis, produced by a joint motor, the same product distributor, the same treated product collector, or even the same wave generator.

The arrangement of a plurality of exposure waveguides operating in parallel allows, in practice, a treated product flow rate to be increased, since for each exposure waveguide, the flow rate is restricted by the section of the cavity of said exposure waveguide, imposed by the single-mode propagation of the waves, and by the exposure time of the treated product, which limits the speed at which said product moves in the exposure waveguide.

The disclosed embodiment can thus be used to continuously treat a large quantity of product in an industrial installation.

Applications

Treatment can consist of a single heating step for bringing a product to a given temperature, for example in view of a subsequent transformation operation, which heating will take place quickly with the disclosed embodiment and produce a homogeneous temperature in the product.

Treatment can consist of the dehydration, to a greater or lesser degree, of a product containing water, the possibility of monitoring a precise profile of the temperature variations allowing for the level of dehydration to be controlled, as well as the desired secondary effects and those to be avoided.

Treatment can consist of baking a product, in the presence of steam or otherwise. In the case of baking in the presence of steam, the exposure waveguide, at least in the portion wherein said baking in the presence of steam takes place, occurs with sufficient sealing to maintain a heated or superheated steam level required for the baking.

Treatment can consist of roasting.

Treatment can consist of heat sterilisation.

Treatment can consist of steam cracking, i.e. splitting the long molecules contained in the product in the presence of steam.

Treatment can consist of shelling, i.e. separating a shell or hull from a seed, in this case by evaporating the water contained in the product, whereby the steam causes the mechanical separation of the shell or hull.

Treatment can consist of extensive dehydration of minerals by evaporating the bound water contained in the dry material.

In general, the device and the method of the disclosed embodiment concern all treatment processes for a product containing at least one polarized dielectric material capable of being heated by exposure to radiofrequency microwaves, requiring the product to be placed under precise temperature conditions by following a thermal cycle.

In particular, it should be noted that some products that may appear not to meet the microwave heating requirement can be treated by a prior preparation step, for example by hydration, whereby water is a polarised dielectric molecule well suited to heating by microwaves.

Provided that they have the qualities listed above, the treatments can be applied to plant-derived products, animal-derived products or mineral-derived products, which can be raw products, transformed products or prepared products.

One requirement for implementing the device is that the product must have a granular form, i.e. it must be sufficiently fragmented and have a physical structure in order to guarantee the total and homogeneous filling and the emptying of the sliding volumes conveying the product in the exposure waveguide.

In terms of shape, the seeds will preferably be rounded in shape or have smooth edges to ease product flow and reduce the risks of blockages formed by seeds with sharp edges.

Further to the dimensional and shape requirements resulting from these mechanical constraints, the seeds or unitary components of the product also have dimensions and shapes that allow for the relatively complete and homogeneous filling of the exposure waveguide with the product relative to the interactions between the material and the microwaves used, and despite the unavoidable voids present between the seeds. In order to meet this condition, a person skilled in the art will ensure that the filling of the sliding volumes and of the waveguide, resulting from the characteristics of the seeds, produces a substantially isotropic environment throughout the exposure waveguide, relative to the electromagnetic waves implemented.

One advantage of the disclosed embodiment in treating products concerns the rapidity of the product heating step and the homogeneity of the temperatures obtained in the product volume, for which heating requires substantially less energy than heating processes using conventional methods implementing thermal conduction of the product when exposed to a heat source.

Another advantage is the possibility of creating, by adapting the applicator, the number of incoupling waveguides, the points on the exposure waveguide, and the microwave powers incoupled into the exposure waveguide by each of the incoupling waveguides, a temperature profile as a function of the time during which the product is exposed.

Another advantage is the continuous operation of the applicator, through which passes a product flow, which allows large quantities of product to be treated in a shorter period of time than conventional solutions.

The macroscopic seeds of the granular product that must be treated in the device correspond, for example, to products naturally present in a granular form such as raw plant seeds, for example wheat seeds, hazelnuts or walnuts, and peas, etc.

Such macroscopic seeds are, for example, transformed products such as calibrated crushed or fragmented materials that meet the dimensional and shape restrictions disclosed hereinabove. Such fragmented products can, for example, result from the cutting of plant leaves, fruit, vegetables, tubers or any other product capable of being divided into fragments.

Such macroscopic seeds are, for example, prepared products such as food pellets intended for human or animal consumption, or wood pellets intended for combustion.

The product can also take on the form of a powder, for example flour of plant or animal origin, or for example a mineral powder.

The product can also take on the form of a more or less viscous liquid, for example an oil, an aqueous or non-aqueous solution, or an emulsified multiphase liquid. In such cases, care will obviously need to be taken to implement a sufficiently water-tight exposure waveguide, at least in the portion of said exposure waveguide through which the product passes.

The device can thus be implemented for heat treating plant-derived products such as seeds, fruit, tubers, leaves or any other part of a plant.

Nuts such as: walnuts, hazelnuts, almonds, and pods, etc. can thus be treated.

Grains such as: corn, wheat, barley, rye, oat, rice, sorghum and in general gramineae grains and seeds can thus be treated.

Fabaceae seeds such as: beans, peas, lentils, soya beans and peanuts, etc. can thus be treated.

Tubers or roots can thus be treated.

Fruit eaten as vegetables such as: cucurbitaceae fruit, solanaceae fruit, etc. or fruit eaten as fleshy fruit such as: berries, drupes, apples, etc. or other fruit such as: citrus, pineapples, etc. can thus be treated.

Edible seeds of other categories such as: chestnuts, coffee grains, cocoa beans, etc. can thus be treated.

All or part of a plant such as: leaves, branches, bark or roots can thus be treated.

The seeds treated are, for example, so-called oil or oleaginous seeds, or so-called protein or proteaginous seeds, or so-called oleoproteaginous seeds.

The treatment of plant-derived products is, for example, performed with the intention of modifying the water content of the product, either in order to bring this water content to a desired value for preservation purposes, or to bring this water content to a value suitable for subsequent transformation of the product.

The treatment of plant-derived products is, for example, performed with the intention of transforming the physical-chemical properties thereof, such as the denaturation of enzymes responsible for product degradation during storage.

For example, the product is subjected to continuous microwave CW radiation for a duration of about 180 seconds, wherein a temperature profile as a function of time is chosen in order to denature the phospholipase enzymes degrading the organoleptic properties of treated products.

Product treatment can be baking, baking in the presence or absence of steam, grilling or roasting.

Baking in the presence of steam takes place in the exposure waveguide advantageously by reusing the superheated steam produced during heating, and drying takes place advantageously by water evaporation with steam aspiration through a porous wall of the stator.

Product treatment can take place on products, for example, intended for human or animal consumption, for cosmetic purposes, for medicinal purposes or for purely physical-chemical purposes, for example for the preparation of colourings.

Products can also be shaped products, such as the aforementioned plant-derived products, having undergone transformations, for example in order to take on the form of flakes, pieces of smaller dimensions, or powders, etc.

The products can also be prepared products such as pellets manufactured for human or animal consumption, or wood pellets intended for combustion, etc.

The products can also be animal-derived products such as flour.

The products can also be mineral-derived products such as ores or powders.

The device, the applicator and the method of the disclosed embodiment are used to bring the temperature of the products to a desired value, whereby the temperature is obtained quickly with a reduced energy cost, and the precise temperature is obtained in a homogeneous manner throughout the entire volume of the product.

Tests conducted at the prototype stage measured the levels of accuracy and temperature deviations between the different points in the volume of the heated material of less than five degrees centigrade, allowing in most cases a homogeneous treatment to be obtained for the products.

What is claimed is:

1. An applicator for the thermal treatment of a particulate product containing at least one polarized dielectric material wherein said product is exposed to electromagnetic microwave radiation in a waveguide cavity into which electromagnetic waves are incoupled, characterised in that:

a section of the waveguide cavity is configured to guide an implemented microwave frequency so that microwaves are guided throughout the waveguide cavity so as to propagate in a single-mode propagation between side walls of the waveguide cavity, extending in a longitudinal direction, in the longitudinal direction of the waveguide cavity, the waveguide cavity comprising an inlet opening for the product, an outlet opening for said product, separated from the inlet opening in the longitudinal direction of the waveguide cavity, and the applicator comprises a conveyor system configured for conveying the product in the waveguide cavity in a continuous flow, following the longitudinal direction of the waveguide cavity, between the inlet opening and the outlet opening, said conveyor system comprising partitions, formed of a material that is transparent to the radiofrequency waves implemented in said applicator, that with the side walls of the waveguide cavity define adjoining sliding volumes extending between the side walls, so as to partition the waveguide cavity, moving inside the waveguide cavity, in the longitudinal direction of said waveguide cavity from the inlet opening towards the outlet opening, so as to maintain total and homogeneous filling of the waveguide cavity by the product during the conveying thereof.

2. The applicator according to claim 1, comprising at least one incoupling waveguide, one far end whereof is connected to the waveguide cavity, at a radio slot of the waveguide cavity, for incoupling microwaves, propagating in said at least one incoupling waveguide, inside the waveguide cavity.

3. The applicator according to claim 2, comprising a plurality of incoupling waveguides, each comprising a far end connected to the waveguide cavity, at a radio slot of the waveguide cavity, and wherein radio slots are distributed between the inlet opening and the outlet opening, offset from one another on the waveguide cavity in the longitudinal direction of said waveguide cavity.

4. The applicator according to claim 3, wherein a microwave radiation power incoupled into the waveguide cavity by each of the incoupling waveguides, is defined in order to determine a temperature curve as a function of the time the product circulates in said waveguide cavity.

5. The applicator according to claim 3, comprising at least two incoupling waveguides and wherein a total continuous microwave energy incoupled into the waveguide cavity is distributed between the incoupling waveguides.

6. The applicator according to claim 1, wherein the waveguide cavity has a toroidal shape, for which a line from the centers of sections of said waveguide is circular, and wherein the conveyor system comprises a rotor, via which partitions are driven, of which a rotation relative to a fixed structure of the waveguide cavity, constituting a stator, conveys and/or controls the conveying of the product in the waveguide cavity.

7. The applicator according to claim 1, wherein the waveguide cavity is open at ends thereof so as to form a linear waveguide with a cylindrical cavity or a helical cavity, and wherein the conveyor system drives the through feed of the sliding volumes in said waveguide cavity between the open ends, from one end corresponding to the inlet opening to the other end corresponding to the outlet opening.

8. The applicator according to claim 1, wherein the waveguide cavity is configured to guide the implemented microwave frequency perpendicular to the longitudinal direction, and is rectangular and has standardized dimensions for a frequency of 915 MHz, or standardized dimensions for a frequency of 2.45 GHz.

9. The applicator according to claim 1, wherein the waveguide cavity comprises a plurality of waveguide cavities which are arranged to operate in parallel.

* * * * *